United States Patent [19]

Ross et al.

[11] 4,051,996

[45] Oct. 4, 1977

[54] TRAVEL ENVELOPE CONSTRUCTION HAVING INTEGRALLY FORMED BAGGAGE IDENTIFICATION LABELS

[75] Inventors: Martin I. Ross, New York; Arthur M. Rogers, Far Rockaway, both of N.Y.

[73] Assignee: Exclusive Envelope Corporation, New York, N.Y.

[21] Appl. No.: 631,058

[22] Filed: Nov. 12, 1975

[51] Int. Cl.[2] ..... B65D 27/08

[52] U.S. Cl. ..... 229/72; 150/39; 283/20

[58] Field of Search ..... 229/70, 72, 74; 40/6, 40/359; 283/20, 57, 23; 150/39

[56] References Cited

U.S. PATENT DOCUMENTS

| | | | |
|---|---|---|---|
| 1,478,647 | 12/1923 | Glisson | 283/23 |
| 1,558,780 | 10/1925 | Betham | 283/23 X |
| 2,749,021 | 6/1956 | Hiersteiner | 229/72 |
| 3,070,280 | 12/1962 | Richmond | 229/62 X |
| 3,164,317 | 1/1965 | Bogen | 229/73 |
| 3,228,129 | 1/1966 | Gwinn et al. | 283/20 X |
| 3,426,961 | 2/1969 | Allison | 229/70 |
| 3,472,444 | 10/1969 | Aliff, Jr. et al. | 229/70 |
| 3,655,119 | 4/1972 | Thompson | 229/72 |
| 3,734,396 | 5/1973 | Cowan | 229/70 X |
| 3,788,540 | 1/1974 | Sammons | 229/72 |

*Primary Examiner*—Stephen P. Garbe
*Attorney, Agent, or Firm*—Philip D. Amins

[57] ABSTRACT

A travel envelope construction is provided having integrally formed baggage identification labels and, in selected instances, an integrally formed boarding pass. The envelope construction comprises a right outer panel secured to a left outer panel, in turn secured to a central panel. The central panel is provided with integrally formed baggage identification labels detachable therefrom by means of predeterminedly formed serrations or score lines. In like manner, the central panel may also be provided with a separable boarding pass which is detachably secured to said central panel along a predetermined serration.

49 Claims, 11 Drawing Figures

2
20
16
30
10
14
NAME
ADDRESS
34
3
NAME
ADDRESS
30
34
12
3
32
24
26
18
2
22

16
35
30
10
34
36
34
38
18
28
24
26

10
35
20
14
38
16
36
30
18
22

40
30

TRAVEL ENVELOPE CONSTRUCTION HAVING INTEGRALLY FORMED BAGGAGE IDENTIFICATION LABELS

BACKGROUND OF THE INVENTION

The present invention is directed to a new and novel travel envelope construction having integrally formed baggage identification labels and which is generally denoted as a wallet-type travel envelope. In selected embodiments of the invention, there is provided a boarding pass.

Heretofore, there has been no real requirement or necessity for providing travel passengers, especially those utilizing airline travel, with baggage identification labels having provisions to enable passengers to subscribe their names and addresses and to thereafter secure the same to their articles of luggage. At best, the airlines provided two-piece numbered tickets wherein one part was secured to the luggage and the other part was retained by the passenger. However, as will be readily apparent to all airline travelers, in the present era many of the commercially available articles of luggage are so similar in construction, nature and appearance, that it has been exceedingly difficult to recognize one's own luggage without very careful scrutiny.

Accordingly, Federal regulations have recently been enacted and put into effect stipulating that hereinafter all airline passengers must have name and address indicia on all articles of luggage either put aboard of carried aboard any aircraft. This burdensome task has been assigned to the individual air carriers. In many instances, rolls of identification labels have been provided as the ticket terminals but the act of dispensing them is burdensome, expensive and time consuming.

SUMMARY OF THE INVENTION

Accordingly, it is the primary object of the present invention to provide a new and novel travel ticket envelope having integrally formed and detachably secured identification labels.

It is another object of the present invention to provide a travel ticket envelope of the foregoing type for use by airlines.

It is a further object of the present invention to provide the aforedescribed travel ticket envelope which is of the wallet-type.

It is still another object of the present invention to provide an airline travel ticket envelope wherein a predetermined number of identification labels are formed integrally with said envelope.

It is yet a further object of the present invention to provide the aforedescribed travel ticket envelope wherein the same is fabricated from a single continuous sheet of material forming a blank.

It is a more specific object of the present invention to provide an envelope of the aforedescribed type wherein the envelope comprises left and right outer panels and a central panel which has a specified predetermined number of identification labels formed integrally therewith or therefrom.

It is yet another specific object of the present invention to provide the aforesaid identification labels which are of the self-stick type having release-type backing paper thereon.

BRIEF DESCRIPTION OF THE DRAWINGS

The foregoing and other objects, features, improvements and advantages of the present invention will become more apparent to those skilled in the art when reference is had to the detailed description hereinafter considered in conjunction with the accompanying drawings, wherein.

DETAILED DESCRIPTION OF THE PREFERRED EMBODIMENTS

Figure 1:
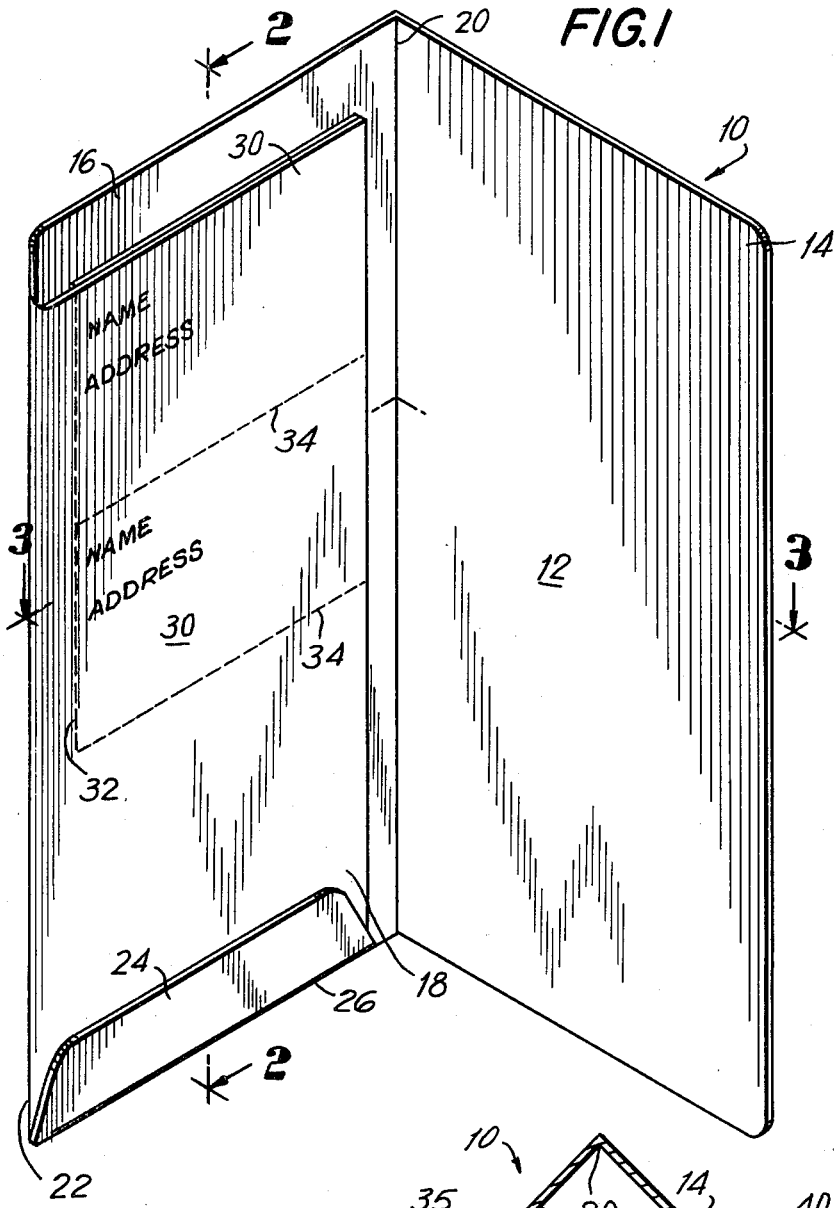
FIG. 1 is a perspective view of an opened travel ticket envelope of the wallet-type having the integrally formed and detachable identification labels, pursuant to a first embodiment of the present invention.
Figure 2:
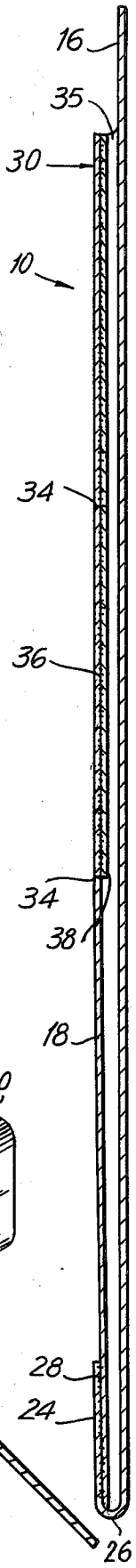
FIG. 2 is a sectional view of the envelope construction of FIG. 1 taken along the line 2—2 thereof.
Figure 3:
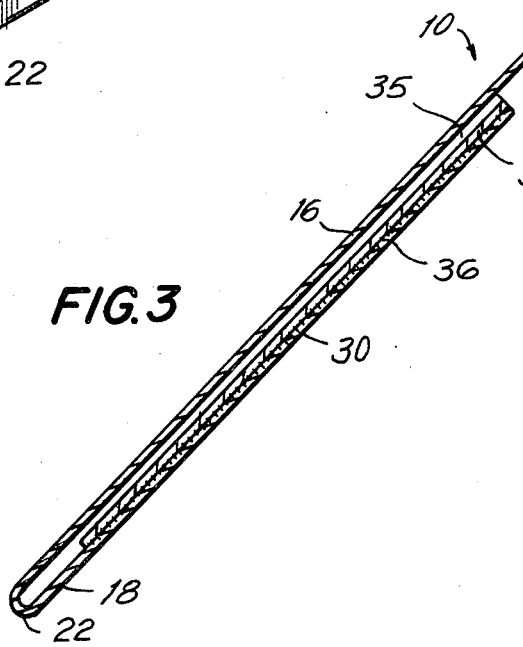
FIG. 3 is a sectional view taken on the line 3—3 of FIG. 1.

Referring now to the drawings and more particularly, to FIGS. 1 through 3 thereof, there is shown a new and novel wallet-type travel ticket envelope constructed in accordance with the principles of the present invention and depicting a first embodiment thereof.

The envelope is generally denoted by the reference numeral 10 and is fabricated from a single continuous sheet of material 12, which sheet may be described as the blank for forming the final envelope construction. It is herein to be noted that the wallet envelope construction herein is similar to those presently existing and utilized by the airlines for envelope enclosures for passenger tickets and other required papers normally kept by passengers with their airline tickets.

The envelope construction 10 comprises a right outer panel 14, a left outer panel 16 and a central panel 18. However, the panels 14 and 16 may be deemed to be the right outer panel portion and the left outer panel portion, respectively, of a singular outer panel construction. The panels 14 and 16 are disposed in contiguous adjacent relationship and are separated by a fold line 20. Similarly, the central or inner panel 18 is connected to the left side portion 16 and is separated by a fold line or bend 22. The bottom portion of the left outer panel 16 is provided with an edge portion or tab 24 which is folded along line 26 and secured to the bottom edge portion of the central panel 18. The tab portion 24 may be secured by means of an adhesive layer 28 interposed between the tab portion and the lower portion of the central panel 18 or by any other known securement means, whether adhesive or otherwise. In this regard, it would also be apparent to those skilled in the art that the bottom portion of the central panel 18 could be secured to the bottom portion of the left outer panel 16 by an adhesive layer interposed between said bottom edge portions or by a thermoplastic layer interposed therebetween or externally thereof by a standardized heat sealing operation thereon. Similarly, the tab portion 24 could be securedly interposed between the left outer panel 16 and the central panel 18.

The central panel 18 includes, in the present embodiment, two identification labels, generally denoted by the reference numeral 30, having provisions for name and address indicia of a passenger imprinted thereon. The labels 30 are disposed at the upper portion of the central panel 18 and are detachable from said central panel by longitudinal and vertically disposed score lines, herein also defined as serrations, 32 and lateral and horizontally disposed score lines or serrations 34. The identification labels 30 are partially fabricated from the central panel 18, the same being the imprinted front face thereof. A self-sticking adhesive layer 36 is disposed on the rear surface of the label and a release-type backing paper or sheet 38 is disposed upon and covers the adhesive layer 36 so as to prevent premature and undesirable adhesion of the labels 30, either to the inner surface of the left outer panel 16 or to the airline tickets or any other papers which may be inserted in the space between the central panel 18 and the left outer panel 16 forming the wallet-type pocket denoted by the reference numeral 35.

Figure 4:
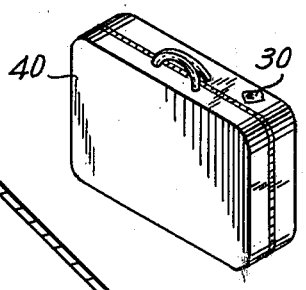
FIG. 4 is a perspective view of an article of luggage having one of the identification labels of the envelope construction of FIG. 1, adhered thereon.

After a passenger has been issued his tickets, he would then insert the same within the wallet pocket 35 and either at home, at the passenger terminal or at the time of boarding the aircraft, separate either one or both of the identification labels 30 by tearing along the score lines 32 and 34 to the extent necessary to remove the predetermined number of labels desired. It is presumed that the passenger would have already subscribed the required name and address information on said labels. The passenger would then merely pull away the backing substrate layer 38 and apply the self-sicking adhesive layer 36 upon the article of luggage 40 (as shown in FIG. 4) to properly identify the article of luggage, complying with the applicable Federal Aviation Administration regulations and preventing any other passenger from mistaking their luggage from this particular article of luggage by merely referring to the clearly visible identification label secured thereon.

Attention is directed to the fact that although two separable, contiguous identification labels have been shown and described herein, it is within the comtemplation and purview of the present invention to provide a travel ticket envelope construction having only a singular identification label. However, it is thought that this narrow and limited construction would not be as useful as the multiple label variation depicted in FIGS. 1 through 3 which provides greater latitude of use for more passengers; i.e., for those having either one or two articles of luggage.

It is herein to be noted that although the identification labels may be severed from the central panel 18, the central panel still maintains its structural integrity due to the fact that the entire longitudinal left hand portion remains intact and further, in view of the fact that the entire lower portion of the central portion remains intact and secured to the left outer panel 16. It is also to be noted that the upper lateral edge of the central panel 18 is disposed in longitudinally recessed relationship with respect to the upper lateral edge of the left outer panel 16.

Figure 5:
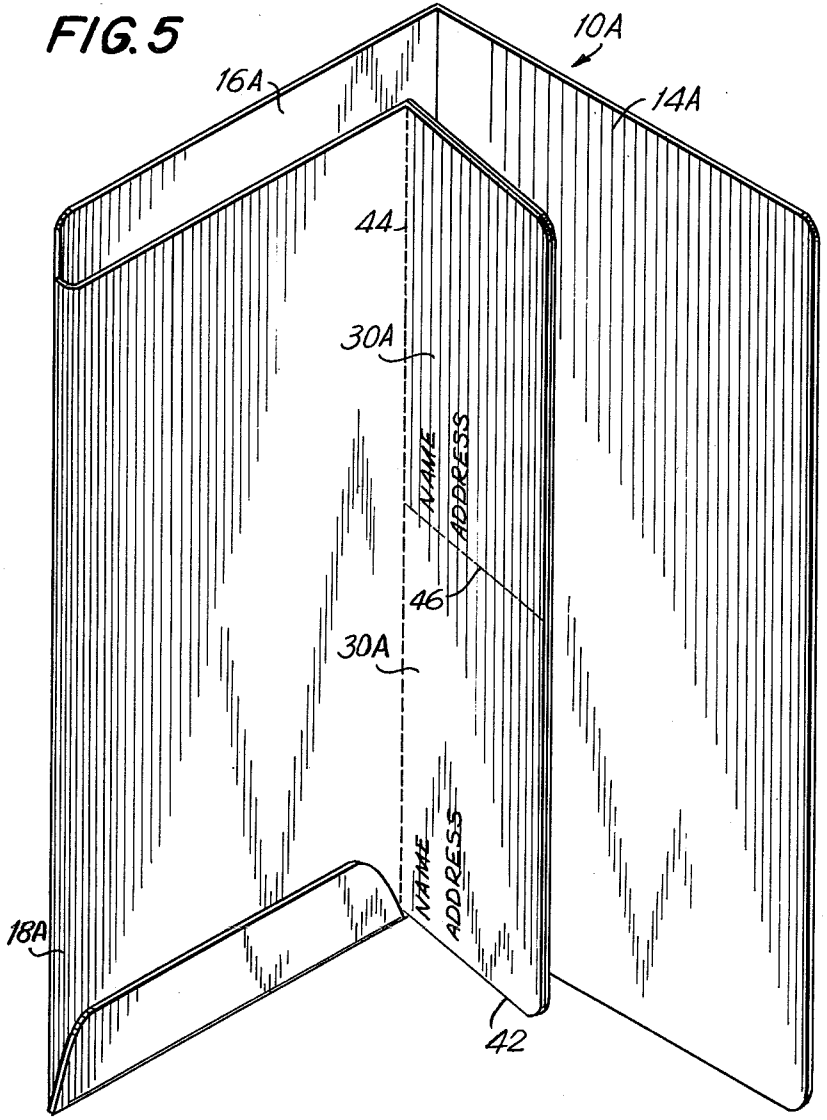
FIG. 5 is a perspective view of a second embodiment of the wallet-type travel ticket envelope of the present invention.

Referring now to FIG. 5 of the drawings, there is depicted a second embodiment of the invention wherein similar reference numerals are used to denote similar parts.

In this embodiment, there is provided a travel ticket envelope construction of the wallet-type designated by the reference numeral 10A, which includes the right outer panel 14A, a left outer panel 16A and a central panel 18A. The panel 18A has a tab portion 42 which is detachably secured thereto by means of a longitudinal and vertically disposed score line or serration 44. The tab portion 42 is provided with a horizontal and lateral score line 46 dividing said tab portion 42 in half. The tab portion 42 thus provides two identification labels 30A. It will be apparent that the identification labels 30A are of the same construction as the labels 30, as described hereinabove in conjunction with FIG. 1. Thus, when a passenger desires to utilize the labels 30A, the same is detached from the central panel 18A by tearing along the portion of the score line 44 and thereafter tearing along the score lines 46. Thereafter the backing sheet is removed and the label is capable of adhesive securement to an article of luggage.

Figure 6:
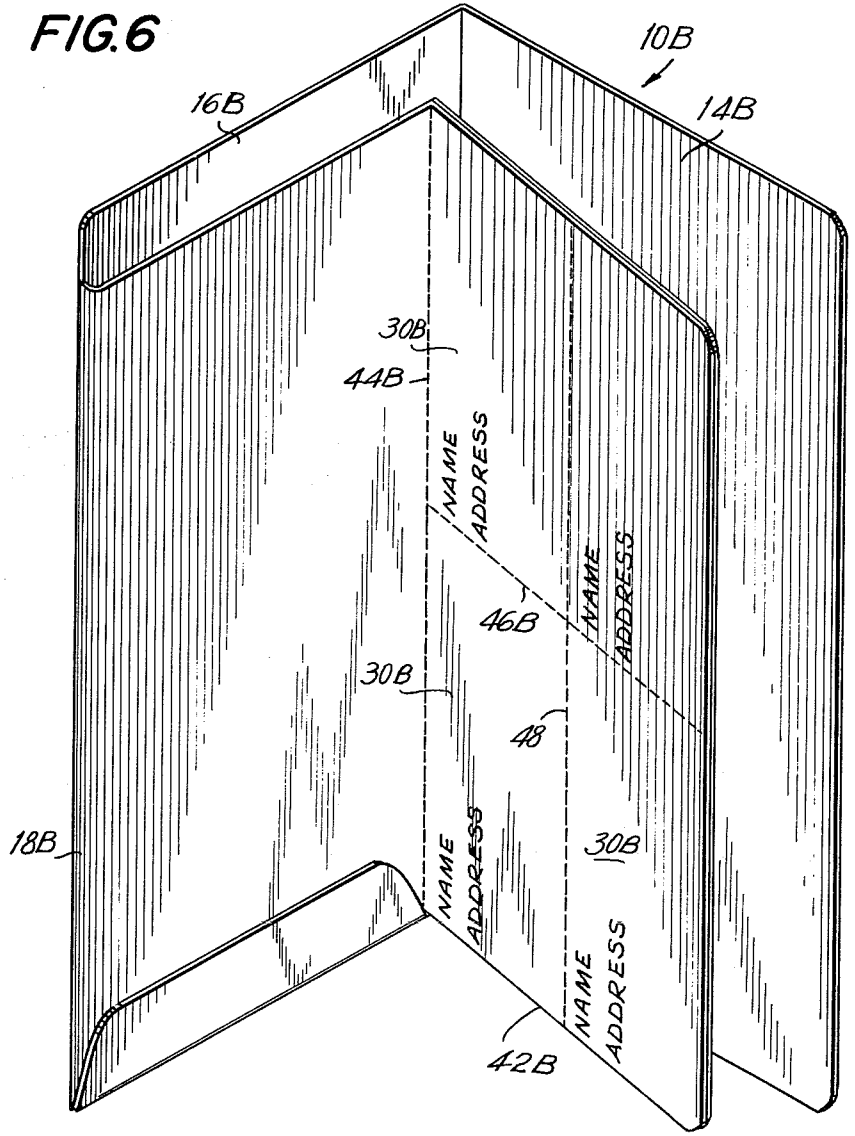
FIG. 6 is a third embodiment of the wallet-type travel ticket envelope constructed in accordance with the principles of the present invention.

With reference to FIG. 6, there is shown another embodiment of the wallet-type travel ticket construction of the present invention, which is generally denoted by the reference numeral 10B. The construction 10B includes right outer panel 14B, left outer panel 16B and a central panel 18B. In this embodiment, the tab portion 42B is wider than that of the tab 42 depicted in FIG. 5 and defines and forms four separable and individual identification labels 30B. The construction 10B is provided with a vertical score line 44B and a parallel vertical score line 48. The horizontal score line 46B extends along the entire lateral dimension of the tab portion 42B. Thus, the score lines 44B, 46B and 48 divide the tab portion 42B into the four separable identification labels 30B, described hereinabove.

Figure 7:
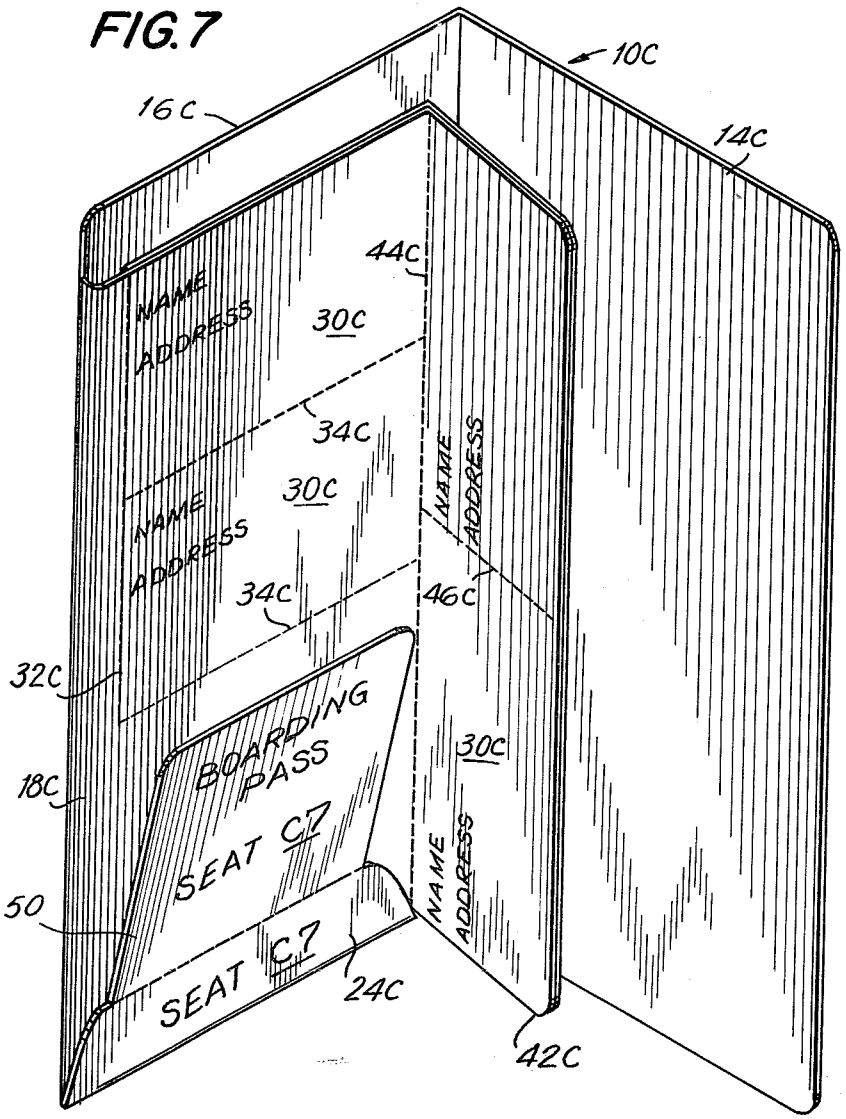
FIG. 7 is a perspective view of a fourth embodiment of a wallet-type travel ticket envelope having an integrally formed boarding pass included therewith.

With reference now to FIG. 7 of the drawings, there is shown another embodiment of the wallet-type travel ticket construction denoted generally by the reference numeral 10C. In this embodiment, the central panel 18C is provided with a vertical score line 44C at the right edge thereof to detachably secure a tab portion 42C thereto. The tab portion 42C is provided with a lateral score line 46C dividing the same into two identification labels 30C. The central panel 18C, per se, is provided with a vertical score line 32C and lateral score lines 34C defining another pair of identification labels, also denoted by the reference numerals 30C. There is thus provided an envelope construction which provides four detachable identification labels, wherein two of said labels may be removed by detachment of the tab 42C, in the manner discussed hereinabove in conjunction with FIG. 5, while still maintaining the structural integrity of the entire envelope construction 10C and providing additional identification labels which may be required at a subsequent time; such as, immediately prior to the boarding of an aircraft.

In this embodiment of the invention, the envelope is provided with an extended lower tab portion 24C which has secured thereto a freely extending and upwardly disposed tab member 50. The tab member 50 is intended to function as a boarding pass and has imparted thereon indicia representative of a seat assigned to a passenger on an aircraft. Since this boarding pass will be removed from the envelope 10C when a passenger boards the aircraft, the seat indicia is also subscribed on the tab portion 24C.

It will, therefore, be readily apparent to those skilled in the art that the present envelope construction is highly compact and provides a plurality of required and attendant functions which can easily be performed by an attendant, airline representative or a ticket agent, without requiring the forgoing personnel to look through and obtain a plurality of individual and separable papers for the passenger.

Figure 8:
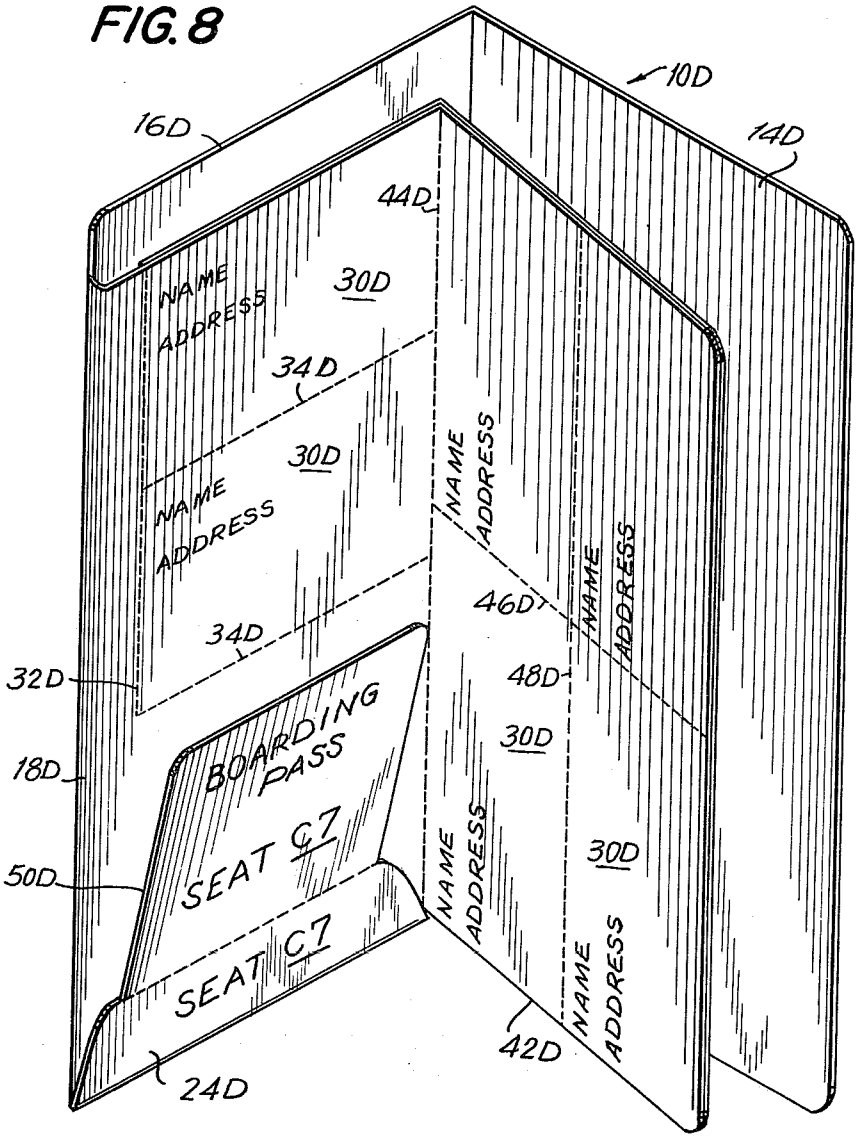
FIG. 8 is a fifth embodiment of a wallet-type travel ticket envelope having a boarding pass formed integrally therewith.

Referring now to FIG. 8 of the drawings, there is shown another embodiment of the wallet-type travel ticket construction which is in effect a modification of that construction depicted in FIG. 7.

In this embodiment, the envelope construction 10D comprises a central panel 18D having detachably secured thereto an enlarged tab portion 32D provided with parallel, vertically disposed score lines 44D and 48D and an extended lateral and horizontal score line 46D which divides said tab portion 42D into four separable and detachably secured identification labels 30D.

The central panel 18D is provided with score lines 32D and 34D which provide two additional, separable and detachable identification labels 30D. Thus, the envelope construction 10D provides a travel ticket envelope having six separate identification labels. The construction 10D is also provided with a boarding pass member 50D.

Figure 9:
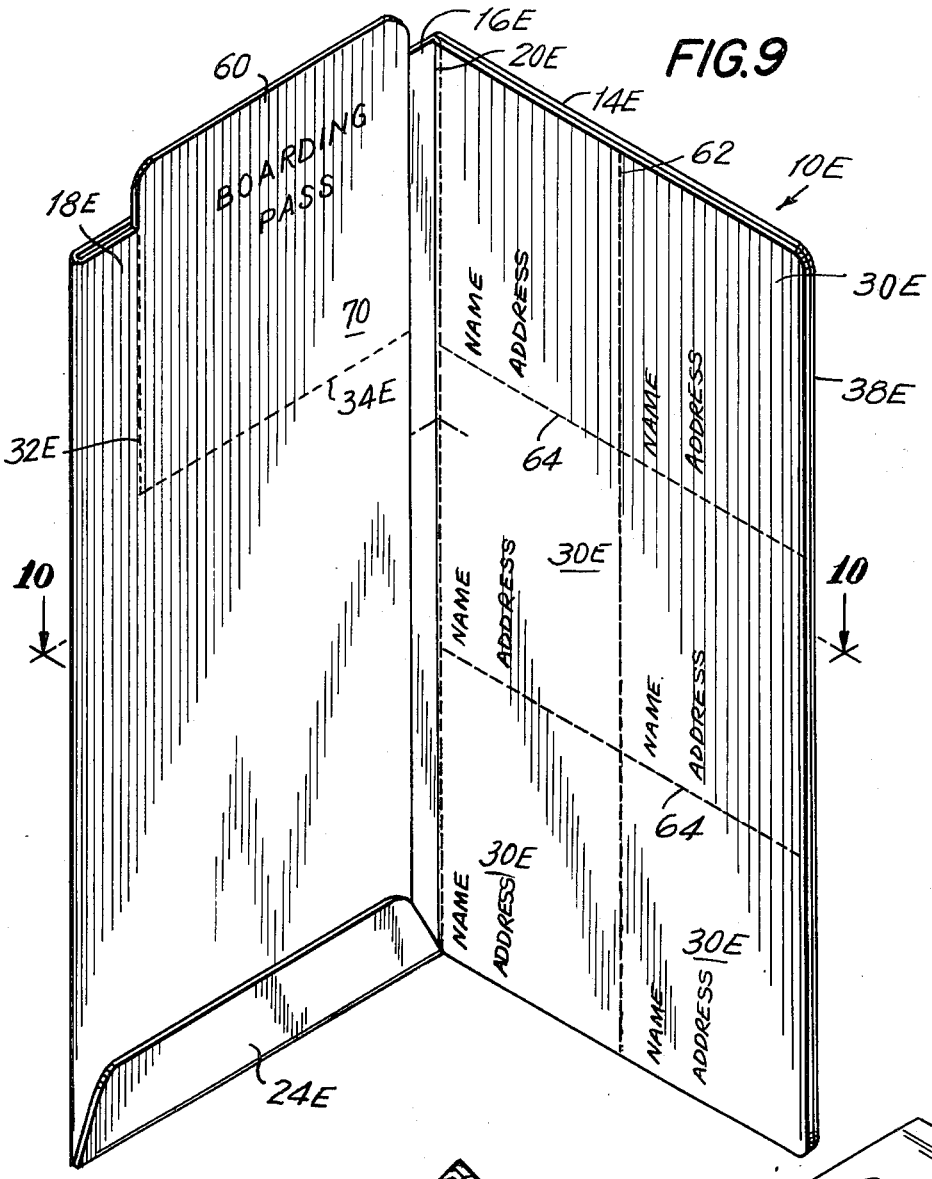
FIG. 9 is a perspective view of a two panel travel ticket envelope constructed in accordance with another embodiment of the present invention.
Figure 10:
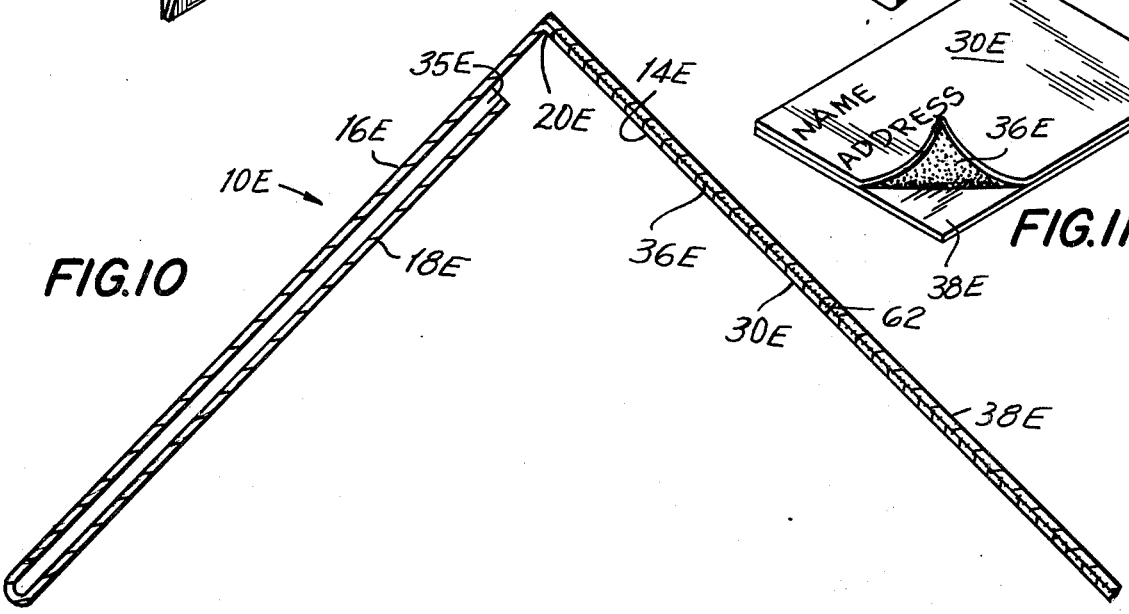
FIG. 10 is a cross-sectional view of the envelope construction of FIG. 9 taken on the line 10—10 thereof.

With reference now to FIGS. 9 and 10, there is depicted another wallet-type travel ticket envelope construction, generally denoted by the reference numeral 10E. In this embodiment, the left outer panel 16E is substantially the same as that described hereinbefore in conjunction with the previous embodiments of the invention. However, the central panel 18E is provided with an upper tab portion 60 which extends beyond the upper edge of the adjoining left outer panel 16E. Of course, the bottom portion of the left outer panel 16E is provided with a lower tab 24E secured to the lower portion of the central or inner panel 18E in a manner similar to that described hereinbefore in conjunction with the previous embodiments of the present invention. The right outer panel portion 14E is joined to the left outer panel portion 16E at a folded score line 20E. The right outer panel portion 14E is also provided with a centrally disposed vertical longitudinal score line 62 and a pair of lateral horizontal score lines 64. The score lines 20E, 62 and 64 effectively divide the right outer panel 14E into a plurality of six individual and detachably secured identification labels 30E. Thus, it will be appreciated that the right outer panel 14E has an adhesive layer 36E on the entire rear surface thereof and a backing sheet 38E superimposed thereon over the entire extent of said right outer panel 14E. It will, therefore, be appreciated that it is very easy and simple for a passenger who does not require the identification labels 30E, or all of the identification labels 30E, to open the envelope and obtain the airline ticket or other papers which may be disposed within the wallet pocket 35E by merely grasping the upper tab 60 of the central panel 18E. Additionally, the central panel 18E may be provided with a longitudinal score line 32E and a lateral score line 34 E, to thereby define a detachable boarding pass 70. The boarding pass 70 is capable of simple detachment from a central panel 18E by a boarding representative or attendant. This is accomplished by grasping of the tab 60 and pulling the same which quickly and easily accomplishes the desired result.

Figure 11:
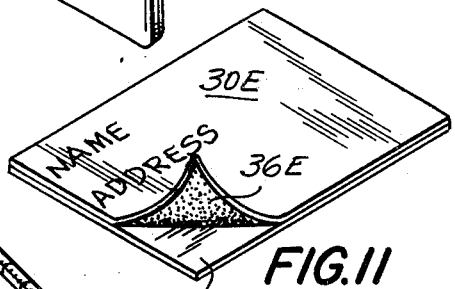
FIG. 11 is a perspective view of one of the identification labels of the envelope construction of FIGS. 1 through 10 depicting a portion of the label being peeled away from the release backing sheet of the identification label portion of the envelope.

As clearly illustrated in FIG. 11, the identification 5 label is easily readied for use by merely peeling the same away from the backing sheet 38E, so as to expose the adhesive backing layer 36E.

Attention is directed to the fact that in all of the specific embodiments of the invention described hereinabove, all of the envelope constructions are fabricated from a blank comprising a single continuous sheet of material.

It will be readily apparent to those skilled in the art that the present invention provides a new and novel travel ticket envelope construction which is readily adaptable for use by any airline, train, bus, steamship or other transportation carrier, due to the fact that the same simulates those types of envelopes presently in use by said carriers, and which still complies with applicable law by the additional provision of identification labels as an integral part of the envelope construction.

It is to be noted that although the present envelope construction has been shown and described for use as a wallet-type travel envelope and, in particular, as an airline ticket envelope, the use of these constructions is not so limited, as discussed hereinabove. Moreover, the indicia on the detachable identification portions may be other than provision for name and address information. In this regard, attention is directed to the fact that the indicia on said detachable identification labels may be for reservation information, categorization information or any other desired indicia or required information. Thus, the envelope constructions disclosed and described herein, may be for purposes and utilizations which are other than travel.

While we have shown and disclosed various embodiments of our invention and various constructions defining said embodiments, it will be readily apparent to those skilled in the art, that there are many modifications, improvements and changes which will be envisioned therefrom, but will not depart from the spirit and scope of the invention, as discussed and depicted in conjunction with the various preferred embodiments thereof.

What is claimed is:

1. A wallet-type envelope construction comprising an outer panel, and an inner panel, said outer panel being secured to said inner panel along a common edge, means for securing the bottom edge portion of said inner panel to the bottom edge portion of said outer panel, said inner and outer panels having at least two other edges disposed in unsecured and free relationship with respect to one another, said outer and inner panels defining a pocket therebetween capable of having tickets and the like positioned therein, at least a portion of said inner panel having an adhesive layer disposed on the rear surface thereof, said adhesive coated inner panel portion having name and address indicia thereon to form at least one identification label, and said identification label being a detachably secured portion of said inner panel.

2. A wallet-type envelope construction in accordance with claim 1, wherein said identification label is detachably secured by means of serrations formed on said inner panel.

3. A wallet-type envelope construction in accordance with claim 2, wherein selected ones of said serrations are disposed in orthogonal relationship with selected other ones of said serrations.

4. A wallet-type envelope construction in accordance with claim 3, wherein at least one side of said identification label is formed from a portion of one of said free edges of said inner panel.

5. A wallet-type envelope construction in accordance with claim 2, wherein said envelope construction is fabricated from a continuous single sheet of material.

6. A wallet-type envelope construction in accordance with claim 2, wherein said adhesive layer on the rear surface of said identification label has a releasable backing cover layer disposed thereon.

7. A wallet-type envelope construction comprising a right outer panel, a left outer panel, and a central panel, said right and left outer panels being secured to one another along a common fold line, said central panel being secured to one of said right and left outer panels, such that folding of said right and left outer panels along said common fold line causes said central panel to be disposed therebetween and substantially coextensive therewith, said central panel and said one of said left and right outer panels to which the same is secured defining a pocket therebetween capable of having tickets and the like positioned therein, a portion of said central panel having name and address indicia thereon and forming at least one identification label, an adhesive layer disposed on the rear surface of said identification label portion of said central panel, and said identification label portion being detachably secured to the remaining portion of said central panel.

8. A wallet-type envelope construction in accordance with claim 7, wherein said adhesive layer on the rear surface of said identification label portion has a releasable backing cover layer disposed thereon.

9. A wallet-type envelope construction in accordance with claim 7, wherein said identification label portion is detachably secured by means of serrations formed on said central panel.

10. A wallet-type envelope constructon in accordance with claim 9, wherein selected ones of said serrations are disposed in orthogonal relationship with selected other ones of said serrations.

11. A wallet-type envelope construction in accordance with claim 7, wherein said central panel has a bottom lateral edge, and said one of said left and right outer panels has a bottom lateral edge which is secured to the bottom lateral edge of said central panel.

12. A wallet-type envelope construction in accordance with claim 11, wherein said bottom lateral edge of said one of said left and right outer panels has a longitudinally extending bottom lateral edge portion, a lateral fold line formed in said lateral edge portion, and means for securing said bottom lateral edge portion to the bottom lateral edge of said central panel.

13. A wallet-type envelope construction in accordance with claim 7, wherein said central panel is secured to said left outer panel along a common fold line, said central panel has a bottom edge, said left outer panel has a bottom lateral edge, and said bottom lateral edge of said left outer panel is secured to the bottom edge of said central panel.

14. A wallet-type envelope construction in accordance with claim 13, wherein said bottom lateral edge of said left outer panel is provided with a longitudinally extending lateral edge portion, and said longitudinally extending lateral edge portion is secured to the bottom edge of said central panel.

15. A wallet-type envelope construction in accordance with claim 13, wherein said identification labels are detachably secured by means of serrations formed on said central panel.

16. A wallet-type envelope construction in accordance with claim 15, wherein selected ones of said serrations are disposed in orthogonal relationship with selected ones of said serrations.

17. A wallet-type envelope construction in accordance with claim 16, wherein said serrations comprise a longitudinal vertical score line disposed laterally inward of said common fold line between said left outer panel and said central panel, said central panel having a free inner vertical edge, and a lateral horizontal score line extending to the free inner vertical edge of said central panel.

18. A wallet-type envelope construction in accordance with claim 17, wherein there is included a second lateral horizontal score line which is longitudinally offset and parallel to said first lateral score line, and said longitudinal and lateral score lines define two detachably secured identification labels.

19. A wallet-type envelope construction in accordance with claim 14, wherein said longitudinally extending lateral edge portion has a lateral score line dividing said portion into a first section and a second section, means for securing said first section to said bottom edge of said central panel, said second section being detachably secured along said score line and forming a boarding pass having appropriate indicia thereon, and said first section boarding indicia subscribed thereon corresponding to the indicia on said second section.

20. A wallet-type envelope construction in accordance with claim 13, wherein said central panel has a longitudinal vertical score line formed thereon, said score line forming a right central tab portion,
said right central tab portion having said adhesive layer disposed on the rear surface thereof,
at least one laterally extending score line formed on said right central tab portion dividing the same into a plurality of identification labels, and
each of said identification labels having appropriate indicia thereon.

21. A wallet-type envelope construction in accordance with claim 20, wherein
said adhesive layered right central tab portion has a releasable backing layer disposed thereon.

22. A wallet-type envelope construction in accordance with claim 21, wherein
said central panel having an upper lateral edge,
said left outer panel having an upper lateral edge, and
said upper lateral edge of said central panel is longitudinally disposed in recessed relationship with respect to the upper lateral edge of said left outer panel.

23. A wallet-type envelope construction in accordance with claim 13, wherein
said upper lateral edge of said central panel is longitudinally disposed in recessed relationship with respect to the upper lateral edge of said left outer panel.

24. A wallet-type envelope constructon in accordance with claim 13, wherein
said central panel has a first longitudinal vertical score line formed thereon,
said first longitudinal score line forming a right central tab portion,
said right central tab portion having said adhesive layer disposed on the rear surface thereof,
a second longitudinal vertical score line formed on said right central tab portion,
at least one laterally extending score line formed on said right central tab portion,
said lateral and longitudinal score lines dividing said right central tab portion into a plurality of identification labels, and
each of said identification labels having appropriate indicia thereon.

25. A wallet-type envelope construction in accordance with claim 24, wherein
said adhesive layered right central tab portion has a releasable backing layer disposed thereon.

26. A wallet-type envelope construction in accordance with claim 13, wherein
said central panel has a first longitudinal vertical score line formed thereon,
said first score line forming a right central tab portion,
said right central tab portion having said adhesive layer disposed on the rear surface thereof,
at least one laterally extending score line formed on said right central tab portion dividing the same into a plurality of identification labels,
a second longitudinal vertical score line disposed laterally inward of said common fold line between said left outer panel and said central panel,
a lateral horizontal score line extending to said first longitudinal vertical score line,
said last mentioned lateral horizontal score line and said second longitudinal vertical score line defining another identification label, and
said other identification label having an adhesive layer disposed on the rear surface thereof.

27. A wallet-type envelope construction in accordance with claim 26, wherein
said adhesive layers have a releasable backing layer disposed thereon.

28. A wallet-type envelope construction in accordance with claim 26, wherein there is included
a second lateral horizontal score line which is longitudinally offset and parallel to the said first lateral horizontal score line, and
said second longitudinal and said first and second lateral score lines define two other detachably secured identification labels.

29. A wallet-type envelope construction in accordance with claim 28, wherein
said bottom lateral edge of said left outer panel is provided with a longitudinally extending lateral edge portion having a lateral score line dividing said portion into a first section and a second section,
means for securing said first section to said bottom edge of said central panel,
said second section being detachably secured along said score line and forming a boarding pass having appropriate indicia thereon, and
said first section having boarding indicia subscribed thereon corresponding to the indicia on said second section.

30. A wallet-type envelope construction in accordance with claim 24, wherein
said central panel has a third longitudinal score line formed thereon which is disposed inwardly of said common fold line between said left outer panel and said central panel,
at least one lateral horizontal score line extending between said first and third longitudinal vertical score lines,
said last mentioned lateral horizontal score line and said first and third longitudinal score lines defining at least one other identification label, and
said other identification label having an adhesive layer disposed on the rear surface thereof.

31. A wallet-type envelope construction in accordance with claim 30, including
first and second lateral lines extending between said first and third longitudinal vertical score lines defining two other detachably secured identification labels.

32. A wallet-type envelope construction in accordance with claim 30, wherein
said bottom lateral edge of said left outer panel is provided witha longitudinally extending lateral edge portion having a lateral score line dividing said portion into a first section and a second section,
means for securing said first section to said bottom edge of said central panel,
said second section being detachably secured along said score line and forming a boarding pass having appropriate indicia thereon, and
said first section having boarding indicia subscribed thereon corresponding to the indicia on said second section.

33. A wallet-type envelope construction in accordance with claim 30, wherein
said adhesive layers have a releasable backing layer disposed thereon.

34. A wallet-type envelope construction comprising
an outer panel, and
an inner panel, said outer panel being secured to said inner panel along a common edge, means for securing the bottom edge portion of said inner panel to the bottom edge portion of said outer panel, said inner and outer panels having at least two other edges disposed in unsecured and free relationship with respect to one another, said outer and inner panels defining a pocket therebetween capable of having tickets and the like positioned therein, at least a portion of one of said inner and outer panels having an adhesive layer disposed on the rear surface thereof, said adhesive coated panel portion having name and address indicia thereon to form at least one identification label, and said identification label being a detachably secured portion of said one of said inner and outer panels.

35. A wallet-type envelope construction in accordance with claim 34, wherein said identification label is detachably secured by means of serrations formed on said one of said inner and outer panels.

36. A wallet-type envelope construction in accordance with claim 35, wherein said serrations are disposed in orthogonal relationship.

37. A wallet-type envelope construction in accordance with claim 36, wherein at least one side of said identification label is formed from a portion of the free edge of said one of said inner and outer panels.

38. A wallet-type envelope construction in accordance with claim 34, wherein said outer panel comprises a left outer panel portion and a right outer panel portion having a common fold line therebetween, and said identification label portion is formed from said right outer panel portion.

39. A wallet-type envelope construction in accordance with claim 34, wherein said common fold line between said left and right outer panel portions comprises a longitudinal vertical score line, at least one lateral horizontal score line extending from said longitudinal vertical score line to the outer edge of said right outer panel portion, said longitudinal and lateral score lines dividing said right outer panel portion into a plurality of identification labels, and each of said identification labels having appropriate indicia thereon.

40. A wallet-type envelope construction in accordance with claim 39, wherein said adhesive coated right outer panel portion has a releasable backing layer disposed thereon.

41. A wallet-type envelope construction in accordance with claim 39, including three parallel lateral horizontal score lines extending from said longitudinal vertical score line to the outer edge of said right outer panel, and said three parallel lateral score lines and said longitudinal score line forming six separable and detachably secured identification labels.

42. A wallet-type envelope construction in accordance with claim 39, wherein the bottom lateral edge of said left outer panel portion is provided with a longitudinally extending lateral edge portion, and said longitudinally extending lateral edge portion is secured to the bottom edge of said inner panel.

43. A wallet-type envelope construction in accordance with claim 39, wherein the bottom lateral edge of said left outer panel portion is provided with a longitudinally extending lateral edge portion having a lateral score line dividing said lateral edge portion into a first section and a second section, means for securing said first section to said bottom edge of said inner panel, said second section being detachably secured along said score line and forming a boarding pass having appropriate indicia thereon, and said first section having boarding indicia subscribed thereon corresponding to the indicia on said second section.

44. A wallet-type envelope construction in accordance with claim 39, wherein said inner panel is provided with a longitudinally extending upper lateral edge portion, and said upper lateral edge portion of said inner panel extends beyond the upper edge of said outer panel portions.

45. A wallet-type envelope construction in accordance with claim 44, wherein said upper lateral edge portion of said inner panel is disposed adjacent said left outer panel portion and extends beyond the upper edge thereof.

46. A wallet-type envelope construction in accordance with claim 34, wherein said inner panel is provided with a longitudinally extending upper lateral edge portion, and said upper lateral edge portion of said inner panel extends beyond the upper edge of said outer panel portions.

47. A wallet-type envelope construction in accordance with claim 46, wherein said inner panel has a longitudinal vertical score line disposed laterally inward of said common edge between said outer and inner panels, a lateral score line intersecting said longitudinal score line and extending to the free inner vertical edge of said inner panel, and said inner panel portion defined by said intersecting score lines forming a detachable boarding pass.

48. A wallet-type envelope construction in accordance with claim 47, wherein said longitudinal vertical score line is disposed in coplanar vertical alignment with the inner vertical edge of said longitudinally extending upper lateral edge portion.

49. A wallet-type envelope construction in accordance with claim 48, wherein said outer panel comprises a left outer panel portion and a right outer panel portion having a common fold line therebetween, said identification label portion is formed from said right outer panel portion, and said upper lateral edge portion of said inner panel is disposed adjacent said left outer panel portion and extends beyond the upper edge thereof.

* * * * *